US010002721B1

(12) United States Patent
Fasano

(10) Patent No.: US 10,002,721 B1
(45) Date of Patent: Jun. 19, 2018

(54) MULTIPLE CONTACT CIRCUIT BREAKER

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days. days.

(21) Appl. No.: 15/443,820

(22) Filed: Feb. 27, 2017

(51) Int. Cl.
*H01H 33/08* (2006.01)
*H01H 1/36* (2006.01)

(52) U.S. Cl.
CPC ..... *H01H 1/36* (2013.01); *H01H 33/08* (2013.01); *H01H 2201/004* (2013.01); *H01H 2205/002* (2013.01)

(58) Field of Classification Search
CPC ..... H01H 71/08; H01H 71/40; H01H 77/108; H01H 71/2454; H01H 33/64; H01H 5/00; H01H 71/16; H01H 73/045; H01H 73/18; H01H 73/26; H01H 9/44; H01H 1/365; H01H 1/40; H01H 2009/305; H01H 33/662
See application file for complete search history.

(56) References Cited

U.S. PATENT DOCUMENTS 3,740,510 A * 6/1973 Grunert ..... H01H 50/546 200/289
4,684,772 A * 8/1987 Lehman ..... H01H 9/36 200/306
5,163,175 A * 11/1992 Mori ..... H01H 89/08 335/132
5,233,321 A * 8/1993 Blanchard ..... H01H 89/08 335/131
5,339,060 A * 8/1994 Blanchard ..... H01H 71/2409 335/132
6,084,488 A * 7/2000 Macbeth ..... H01H 50/36 335/132
6,310,528 B1 * 10/2001 Kuboyama ..... H01H 71/2409 335/132
2008/0053809 A1 * 3/2008 Shimazu ..... H01H 11/0018 200/530
2012/0037598 A1 2/2012 Fasano
2012/0261382 A1 10/2012 Fasano

* cited by examiner

*Primary Examiner* — Truc Nguyen
(74) *Attorney, Agent, or Firm* — Forge IP, PLLC

(57) ABSTRACT

A circuit interrupter having at least two sets of contacts that are electrically connected in series such that when the at least two sets of contacts are opened, they are opened simultaneously. This functions to increase the distance between the sets of contacts as the distance is additive for the series connected sets of contacts, which increases the arc voltage for breaking any arc that may form between the individual sets of contacts more effectively.

16 Claims, 4 Drawing Sheets

MULTIPLE CONTACT CIRCUIT BREAKER

FIELD OF THE INVENTION

The invention relates to the field of circuit breakers. More specifically, the invention relates to a circuit breaker that includes at least two series connected contacts that are simultaneously opened so as to increase the arc voltage upon contact opening.

BACKGROUND OF THE INVENTION

Circuit interrupters are electrical components that can be used to break an electrical circuit, interrupting the current flow. A basic example of a circuit interrupter is a switch, which generally consists of two electrical contacts in one of two states; either closed, meaning that the contacts are touching and electricity can flow between them, or open, meaning that the contacts are separated, and no electricity can flow between them. A switch may be directly manipulated by a human to provide a control signal to a system, such as a computer keyboard button, or to control power flow in a circuit, such as a light switch.

Another example of a circuit interrupter is a circuit breaker. A circuit breaker may be used, for example, in an electrical panel to limit the electrical current being sent through the electrical wiring. A circuit breaker is designed to protect an electrical circuit from damage caused by an overload or a short circuit. If a fault condition such as a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a terminal connected to a power supply, such as a power line from a power company, and another terminal connected to the circuit that the breaker is intended to protect. Conventionally, these terminals are referred to as the "line" and "load" respectively. The line may sometimes be referred to as the input into the circuit breaker. The load, sometimes referred to as the output, feeds out of the circuit breaker and connects to the electrical components being fed from the circuit breaker.

A circuit breaker may be used to protect an individual device, or a number of devices. For example, an individual protected device, such as a single air conditioner, may be directly connected to a circuit breaker. A circuit breaker may also be used to protect multiple devices by connecting to multiple components through a power wire which terminates at electrical outlets, for example.

A circuit breaker can be used as a replacement for a fuse. Unlike a fuse however, which operates once and then must be replaced, a circuit breaker can be reset (either manually or automatically) to resume normal operation. Fuses perform much the same circuit protection role as circuit breakers. However, circuit breakers may be safer to use in some circumstances than fuses, and may be easier to fix.

For example, in a situation where a fuse blows, interrupting power to a section of a building for example, it may not be apparent which fuse controls the interrupted circuit. In this case, all of the fuses in the electrical panel would need to be inspected to determine which fuse appears burned or spent. This fuse would then need to be removed from the fuse box, and a new fuse would need to be installed.

In this respect, circuit breakers can be much simpler to use than fuses. In a situation where a circuit breaker trips, interrupting power to a section of a building for example, it may be easily apparent which circuit breaker controls the interrupted circuit by looking at the electrical panel and noting which breaker has tripped to the "off" position. This breaker can then be simply flipped to the "on" position and power will resume again.

In general, a typical circuit interrupter has two contacts located inside of a housing. The first contact is stationary, and may be connected to either the line or the load. The second contact is movable with respect to the first contact, such that when the circuit breaker is in the "off" or tripped position, a gap exists between the first and second contact.

A problem with circuit interrupters that operate by separating contacts arises because the energized contacts separate when the circuit breaker is tripped, causing a gap to widen between the contacts while the movable contact moves from the closed position to the open position.

As the contacts begin to separate from the closed position, or approach complete closure from an open position, a very small gap exists between the contacts for a brief time while the contacts are closed or opened. An electric arc may be generated across this gap if the voltage between the contacts is high enough. This is because the breakdown voltage between the contacts is positively related to distance under pressure and voltage conditions in typical applications.

The creation of an arc during switching or tripping the circuit interrupter can result in undesirable side effects which can negatively affect the operation of the circuit interrupter, and which can create a safety hazard.

These effects can have consequences for the operation of the circuit interrupter. One possible consequence is that the arc may short to other objects in the circuit interrupter and/or to surrounding objects, causing damage and presenting a potential fire or electrocution safety hazard.

Another consequence of arcing is that the arc energy damages the contacts, causing some material to escape into the air as fine particulate matter. The debris which has been melted off of the contacts can migrate or be flung into the mechanism of the circuit interrupter, destroying the mechanism or reducing its operational lifespan.

Another effect of arcing stems from the extremely high temperature of the arc (tens of thousands of degrees Celsius) which can crack the surrounding gas molecules creating ozone, carbon monoxide, and other compounds. The arc can also ionize the surrounding gasses, potentially creating alternate conduction paths.

Because of these detrimental effects of arcing, it can be very important to quickly cool and quench the arc to prevent damage to the circuit interrupter.

Various techniques for improved arc quenching are known. For example, U.S. Published Patent Applications No. 2012/0037598 and 2012/0261382, assigned to Carling Technologies, Inc., relate to the use of an electromagnetic field to guide the arc toward an arc splitter.

However, generating an electromagnetic field to move the arc consumes power, and generates heat in the device. In order to avoid this, it has been possible to incorporate a permanent magnet into the circuit interrupter which produces a magnetic field without requiring a supply of current. Even systems that are polarity insensitive have been developed. However, all of these systems focus on a device to draw to guide the arc into an arc quenching device.

Arc quenching devices can be effective in protecting devices, however, they do have lifespans that limit their effectiveness over time. Additionally, elaborate arc quenching systems can add significant cost to the circuit breaker.

Another method for minimizing the development of arcing when contacts are opened or closed in AC systems is to time the opening or closing as near as possible to the zero crossing. However, this method is not available for use in DC systems as there is no zero crossing.

It is therefore desired to provide an alternative system that is usable with a circuit interrupter that overcomes these limitations.

SUMMARY OF THE INVENTION

Accordingly, it is an object of the present invention to provide a circuit interrupter having a structure that functions to more effectively and quickly, extinguish an arc that may develop in the gap between the contacts.

It is further desired to provide a system and method for minimizing the arcing that occurs in a DC system when the contacts are opened or closed.

These and other objectives are achieved by providing a circuit interrupter which includes a first and a second set of contacts that are connected in series with each other. The first set of contacts comprise a first contact and a second contact movable into and out of contact with each other. The second set of contacts comprise a third contact and a fourth contact movable into and out of contact with each other.

The system is designed such that the first and second sets of contact will open and close simultaneously. In other words, the current that flows through the circuit breaker will travel through the current path of the circuit breaker and will travel sequentially through the two sets of contacts. This configuration allows for DC interruption where the double break provide double the arc voltage when interrupting the DC circuit, which is very helpful in breaking an arc as it drives down the fault current proportionally. Since DC sources require the arc voltage to be at least 1.2 to 1.5 times the source voltage to interrupt the DC fault current, it is highly desirable to utilize the configuration described herein that's generates a higher arc voltage during the interruption process.

If the circuit breaker trips or is intentionally opened (either manually or remotely), the two sets of contacts are simultaneously opened together. It should be understood that the arc (breaking) voltage when opening a set of contacts is related to the physical distance of the contacts relative to each other. The greater the distance between the contacts, the greater the arc voltage. By including a series set of contacts, this doubles the distance of one set of contacts (i.e., the opening distance for both sets of contacts is additive), thereby increasing the arc voltage for breaking the arc more effectively and quickly.

The first set of contacts includes a first arc extinguisher and the second set of contacts includes a second arc extinguisher. It is further contemplated that a first magnet associated with the first arc extinguisher may further be provided to urge any arc that develops between the first and second contacts toward the first arc extinguisher. Likewise, it is further contemplated that a second magnet associated with the second arc extinguisher may further be provided to urge any arc that develops between the third and fourth contacts toward the second arc extinguisher.

In some implementations, the circuit interrupter includes at least one first pole piece disposed to direct a magnetic field of the first magnet. The at least one first pole piece may be disposed to concentrate the magnetic field of the first magnet in an area where the arc passes in the vicinity of the first and second contacts. Likewise, the circuit interrupter may include at least one second pole piece disposed to direct a magnetic field of the second magnet. The at least one second pole piece may be disposed to concentrate the magnetic field of the second magnet in an area where the arc passes in the vicinity of the third and fourth contacts.

In some implementations, a magnetic field produced by the first magnet interacts with a magnetic field produced by the arc such that the arc is directed toward the first arc extinguisher regardless of whether the arc is emitted from the first contact or from the second contact. Likewise, a magnetic field produced by the second magnet interacts with a magnetic field produced by the arc such that the arc is directed toward the second arc extinguisher regardless of whether the arc is emitted from the third contact or from the fourth contact.

For this application the following terms and definitions shall apply:

The term "network" as used herein includes both networks and internetworks of all kinds, including the Internet, and is not limited to any particular network or inter-network.

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one embodiment, a circuit interrupter is provided comprising a first set of contacts including a first contact and a second contact, movable into and out of contact with each other and a second set of contacts including a third contact and a fourth contact, movable into and out of contact with each other. The circuit interrupter is provided such that the first set of contacts connected in series with the second sect of contacts and the first set of contacts are configured to open and close simultaneously with opening and closing of the second set of contacts.

In another embodiment, a circuit interrupter is provided comprising a contact arm carrier that is configured to be moveable, the contact arm carrier having a contact arm attached thereto, and a first set of contacts including a first contact and a second contact, movable into and out of contact with each other, the first contact positioned on the contact arm. The circuit interrupter also includes a second set of contacts including a third contact and a fourth contact, movable into and out of contact with each other, the third contact positioned on the contact arm. The circuit interrupter is provided such that the first set of contacts are electrically connected in series with the second set of contacts and the first set of contacts are configured to open and close simultaneously with opening and closing of the second set of contacts.

Other objects of the invention and its particular features and advantages will become more apparent from consideration of the following drawings and accompanying detailed description.

DETAILED DESCRIPTION OF THE INVENTION

Figure 1:
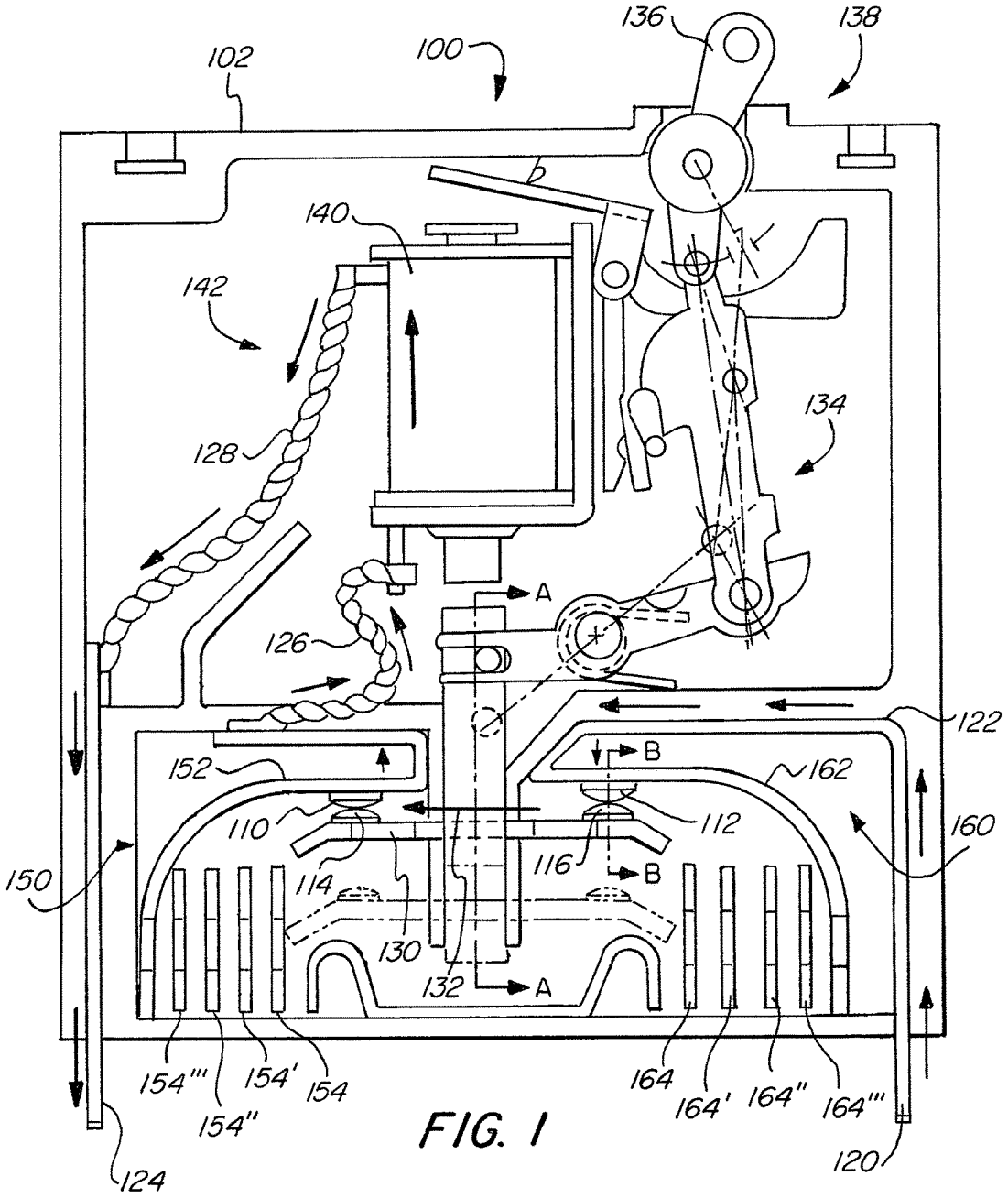
FIG. 1 illustrates components of an example circuit interrupter according to aspects of the invention.

Referring now to the drawings, wherein like reference numerals designate corresponding structure throughout the views.

FIG. 1 illustrates components of an example circuit interrupter 100 having multiple contacts according to aspects of the invention.

Circuit interrupter 100 may be any device which can be used to make and break a circuit using contacts. For example, it will be clear to those having ordinary skill in the art that circuit interrupter 100 may be a simple switch, or may be implemented as a circuit breaker having a housing 102, for example. Housing 102 may include vents to allow gasses and debris produced by arcing to escape housing 102.

Circuit interrupter 100 includes a second stationary contact 112, both of that is electrically connected to line terminal 120 through conductor 122. First stationary contact 110 is electrically connected to load terminal 124 through conductor 126, overcurrent measurement device 140 and conductor 128.

The line terminal receives electricity from a power source, such as, a generator (not shown), which in some applications is supplied by a power company.

Circuit interrupter 100 still further includes a first moveable contact 114 and a second moveable contact 116, both of which are mounted on opposing sides of contact arm 130. Contact arm 130 is, in turn, connected to contact arm carrier 132. Contact arm carrier 132 is further connected to linkage assembly 134 and actuated by handle 136 (collectively a "switch" 138).

First movable contact 114 and second moveable contact 116 are electrically connected in series with each other.

In FIG. 1, the contact arm 130 is shown in the closed position in which first stationary contact 110 is physically contacting first movable contact 114, and second stationary contact 112 is physically contacting second movable contact 116. When contact arm 130 is in the closed position, and electricity can flow between line terminal 120 and load terminal 124.

The assembly is provided such that, when contact arm carrier 132 is displaced downward, contact arm 130 travels downward (see dashed lines illustrating contact arm 130 in an open position) to break or open the contacts. The system is provided so that the connection between first stationary contact 110 and first movable contact 114 is opened simultaneous with the opening of second stationary contact 112 and second movable contact 116.

Contact arm 130 may be actuated via a switch 138, trip mechanism 142, and/or any other known mechanism (not shown) depending on the desired implementation of circuit interrupter 100.

Overcurrent measurement device 140 may be any type of well-known device for measuring current that passes through the circuit interrupter 100. Once a maximum current is reach, the measurement device will function to cause the contact arm 130 to move to an open position. Likewise, the handle 136 will move to an intermediate position to indicate a "tripped" state of circuit interrupter 100.

Also provided in FIG. 1 is first arc extinguisher 150 that is associated with the first set of contacts 110, 114 and second arc extinguisher 160 that is associated with the second set of contacts 112, 116.

First arc extinguisher 150 includes first arc runner 152 positioned at least partially in the vicinity of the first set of contacts 110, 114 and further includes first arc splitting plate 154, which in this illustration, comprises a plurality of first arc splitting plates 154, 154', 154", 154'''.

Second arc extinguisher 160 includes second arc runner 162 positioned at least partially in the vicinity of the second set of contacts 112, 116 and further includes second arc splitting plate 164, which in this illustration, comprises a plurality of second arc splitting plates 164, 164', 164", 164'''.

As can be seen with reference to FIG. 1, the plurality of first arc splitting plates 154, 154', 154", 154''' as well as the plurality of second arc splitting plates 164, 164', 164", 164''' may each be provided parallel with respect to each other and essentially parallel with to the travel of contact arm carrier 132.

The circuit interrupter 100 is designed such that the first set of contacts 110, 114 and second set of contacts 112, 116 open and close simultaneously. The electrical current that passes through the circuit breaker will travel sequentially through the first set of contacts 110, 114 and second set of contacts 112, 116 (arrows are shown for illustrative purposes only to illustrate the current path). As stated previously, DC power sources require the arc voltage to be at least 1.2 to 1.5 times the source voltage to interrupt the DC fault current. The series connected sets of contacts generates a higher arc voltage during the interruption process because the arc voltage is proportionately increased relative to distance between the contacts. In the series connected arraignment, the distance between the contacts is doubled (i.e., the opening distance for both sets of contacts is additive), which in turn, functions to increase the arc voltage for breaking the arc more effectively. This results in less arcing, which reduces damage to the contacts and the surrounding equipment. Likewise, the reduction in arching will reduce the amount of gas and debris that is generated by unwanted arcing.

Figure 2:
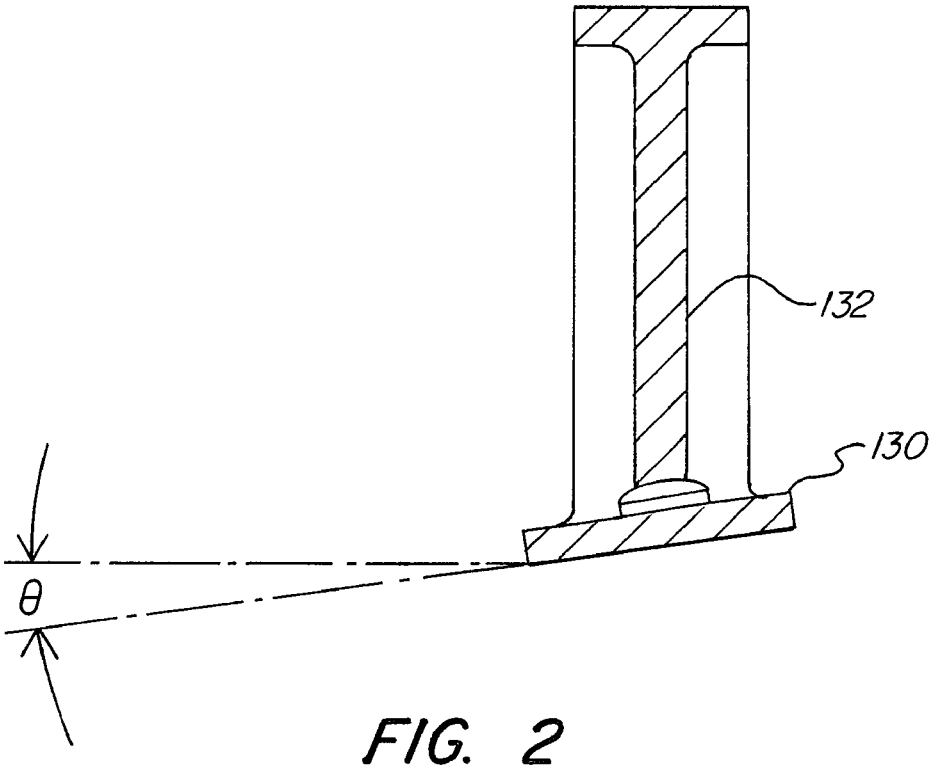
FIG. 2 is a view according to FIG. 1 along Section Line AA.

Turning now to FIG. 2, which is a section view along section AA of FIG. 1, the contact arm carrier 132 is shown with the contact arm 130 attached thereto.

The contact arm 130 is shown positioned at an angle θ with respect to perpendicular (indicated by the dashed line) of contact arm carrier 132.

The following examples are presented to further illustrate and explain the present invention and should not be taken as limiting in any regard. The distances illustrated are intended to indicate general direction of travel of the various parts and members, but are not shown to scale and are merely provided to illustrate the function and interaction of the various structural elements.

Figure 3:
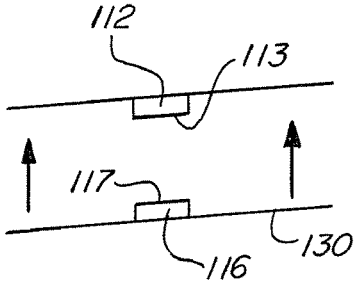
FIGS. 3-5 are views according to FIG. 1 along Section Line BB illustrating the closing of the contacts and the lateral movement of the contacts relative to each other.
Figure 4:
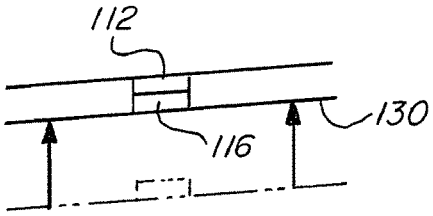
Figure 5:
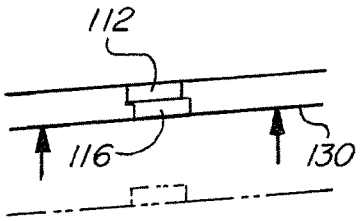

FIGS. 3-5 are section view along section BB of FIG. 1 and show the second set of contacts 112, 116. In FIG. 3, the second stationary contact 112 is shown spaced apart from the second movable contact 116 that is mounted to contact arm 130. It can be seen that a contact surface 117 of second movable contact 116 is aligned with the angle θ of the contact arm 130. Likewise, the second stationary contact 112 has a contact surface 113 that is positioned substantially parallel with contact surface 117. The arrows are provided to indicate the direction of movement of contact arm 130 when contact arm carrier 132 is moved to close the second set of contacts.

FIG. 4 indicates that the second moveable contact 116 has come into physical contact with second stationary contact 112.

FIG. 5 shows lateral movement of the second moveable contact 116 relative to second stationary contact 112. As the contact arm carrier 132 moves the contact arm 130, the contact surface 117 of second moveable contact 116 comes into physical contact with the contact surface 113 of second stationary contact 112. Even after the initial contact of the respective contact surfaces 113, 117 occurs, the contact arm carrier 132 continues to move, if just slightly more. This continued linear movement after initial contact causes the contact surface 117 to slide laterally with respect to contact surface 113. This lateral sliding functions to "wipe" the respective contact surfaces 113, 117 to remove any debris or contamination that may be on the surfaces. This "wiping" action allows for a cleaner contact surface, which in turn, will result in lower resistance between contact surfaces 113, 117 and therefore, will function to lessen any potential heat buildup across the contacts.

FIGS. 3-5 refer to the second set of contacts 112, 116, however, it should be understood that the first set of contacts 110, 114 have a similar structure and function.

Additionally, while only two sets of contacts (110, 114 and 112, 116) are illustrated, one of skill in the art will recognize that more than two sets of contacts may be used. For example, if two different groups (four sets of series connected contacts) where connected in parallel, this would function to commensurately lower the current through each individual set of contacts thereby allowing for smaller and lighter weight contacts to be used. Likewise, three sets of series connected contacts may be used, which would function to increase the opening distance of the contacts when all three sets were opened simultaneously as the distances of each set of contacts is additive. It will be understood by those of skill in the art that numerous configurations of series and series / parallel interconnections of the series connected contacts can effectively be used.

Figure 6:
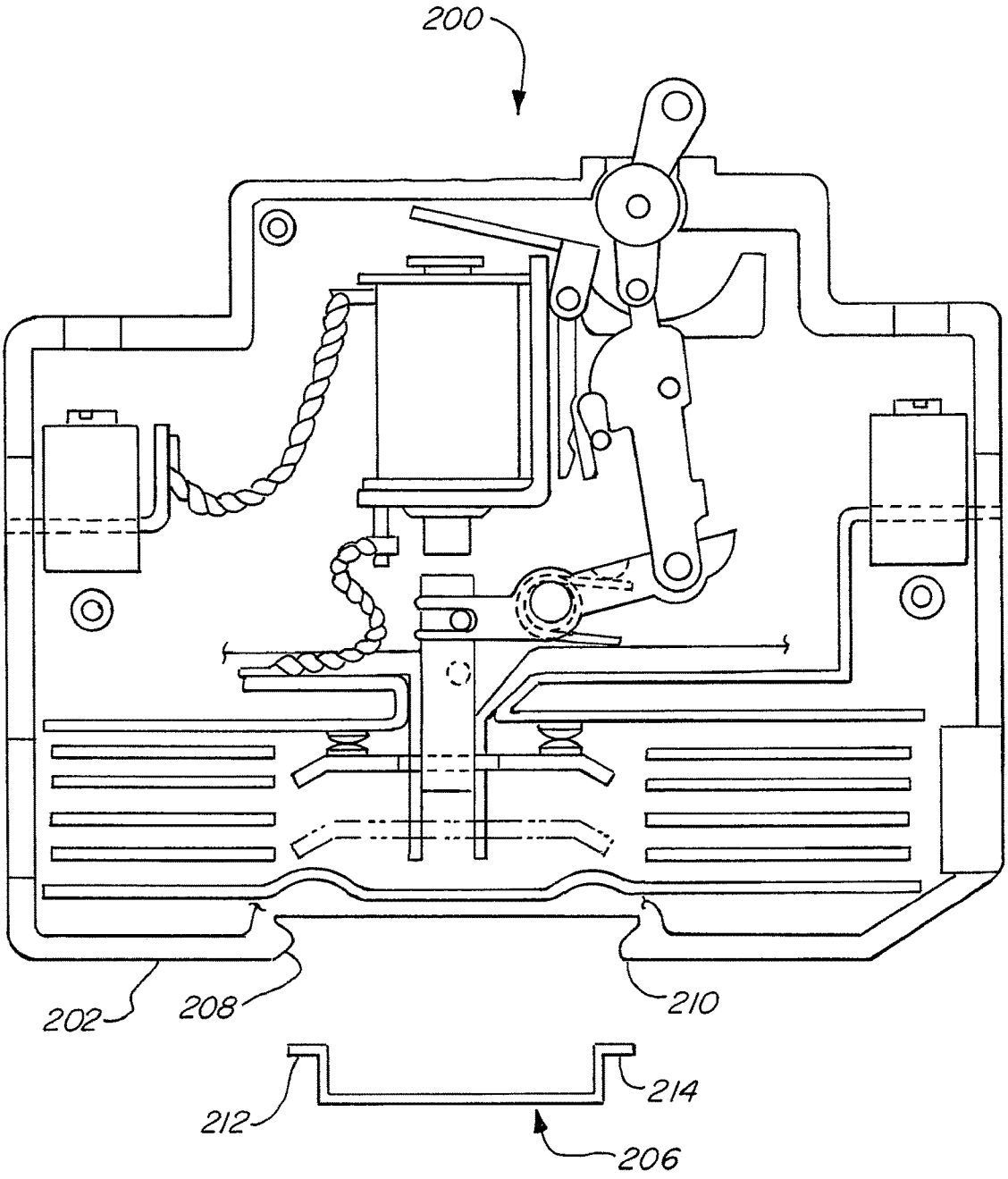
FIG. 6 is an illustration of the circuit interrupter according to FIG. 1.

FIG. 6 shows an alternative configuration showing circuit interrupter 200 where the bottom of housing 202 is shown configured to be mounted to DIN rail 206. For example, the bottom of housing 202 is shown with a first protrusions 208 and a second protrusion 210 that are designed to engage with opposing edges 212, 214 of DIN rail 206.

Protrusion 208 is designed to be deformable such that protrusion 210 may be engaged with edge 214, then the housing 202 can be rotated downward such that protrusion 208 comes into physical contact with edge 212. With the application of downward force, the protrusion 208 deflects inward until protrusion 208 passes below edge 212 at which time protrusion 208 again deflects outward and engages with edge 212 to firmly affix housing 202 to DIN rail 206. This makes for an easy to connect / disconnect circuit interrupter 200 that can be mounted anywhere a DIN rail 206 is mounted.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit interrupter comprising:

a first set of contacts including a first contact and a second contact, movable into and out of contact with each other;

a second set of contacts including a third contact and a fourth contact, movable into and out of contact with each other;

said first set of contacts connected in series with said second sect of contacts;

a contact arm carrier;

a contact arm;

wherein said second and said fourth contacts being positioned on said contact arm;

wherein said first set of contacts are configured to open and close simultaneously with opening and closing of said second set of contacts;

wherein a first plane defines movement of said contact arm carrier and said contact arm defines a second plane; and wherein the second plane is positioned at an angle other than perpendicular to the first plane both when the contacts are open and when the contacts are closed.

2. The circuit interrupter of claim 1, wherein said contact arm comprises a first end and a second end and said second contact is positioned toward said first end and said fourth contact is positioned toward said second end.

3. The circuit interrupter of claim 1, wherein said first and said third contacts are positioned along a third plane that is parallel with said second plane.

4. The circuit interrupter of claim 3, wherein when said second contact comes into physical contact with said first contact and when said fourth contact comes into physical contact with said third contact, the second contact slides laterally relative to the first contact and the fourth contact slides laterally relative to said third contact such that closing of said first and second set of contacts performs a wiping action along a surface of said first and second and said third and fourth contacts.

5. The circuit interrupter of claim 1, further comprising:

a first arc extinguisher associated with said first set of contacts; and a second arc extinguisher associated with said second set of contacts.

6. The circuit interrupter of claim 5, wherein said first arc extinguisher comprises a first arc runner positioned at least partially in the vicinity of the first set of contacts and said second arc extinguisher comprises a second arc runner positioned at least partially in the vicinity of the second set of contacts.

7. The circuit interrupter of claim 6, wherein said first arc extinguisher comprises a first arc splitting plate and said second arc extinguisher comprises a second arc splitting plate.

8. The circuit interrupter of claim 7, wherein said first arc splitting plate comprises a first plurality of plates and said second arc splitting plate comprises a second plurality of plates.

9. The circuit interrupter of claim 8, wherein said first plurality of plates are positioned parallel with respect to each other and said second plurality of plates are positioned parallel with respect to each other.

10. A circuit interrupter comprising:

a contact arm carrier that is configured to be moveable, said contact arm carrier having a contact arm attached thereto;

a first set of contacts including a first contact and a second contact, movable into and out of contact with each other, said first contact positioned on said contact arm;

a second set of contacts including a third contact and a fourth contact, movable into and out of contact with each other, said third contact positioned on said contact arm;

said first set of contacts are electrically connected in series with said second set of contacts;

wherein said first set of contacts are configured to open and close simultaneously with opening and closing of said second set of contacts;

wherein a first plane defines movement of said contact arm carrier and said contact arm defines a second plane; and wherein the second plane is positioned at an angle other than perpendicular to the first plane both when the contacts are open and when the contacts are closed.

11. The circuit interrupter of claim 10, wherein said first and said third contacts are positioned along a third plane that is parallel with said second plane.

12. The circuit interrupter of claim 11, wherein when said second contact comes into physical contact with said first contact and when said fourth contact comes into physical contact with said third contact, the second contact slides laterally relative to the first contact and the fourth contact slides laterally relative to said third contact such that closing of said first and second set of contacts performs a wiping action along a surface of said first and second and said third and fourth contacts.

13. The circuit interrupter of claim 10, further comprising:

a first arc extinguisher associated with said first set of contacts; and a second arc extinguisher associated with said second set of contacts.

14. The circuit interrupter of claim 13, wherein said first arc extinguisher comprises a first arc runner positioned at least partially in the vicinity of the first set of contacts and said second arc extinguisher comprises a second arc runner positioned at least partially in the vicinity of the second set of contacts.

15. The circuit interrupter of claim 14, wherein said first arc extinguisher comprises at least one first arc splitting plate and said second arc extinguisher comprises at least one second arc splitting plate.

16. The circuit interrupter of claim 8, further comprising a housing within which said contact arm, said contact arm carrier, and said first and second set of contacts are contained, said housing configured to be detachably connectable to a DIN rail.

* * * * *